United States Patent [19]

Tipper

[11] 4,065,184

[45] Dec. 27, 1977

[54] PLOW CUTTER ASSEMBLY

[76] Inventor: John M. Tipper, Tams, W. Va. 25933

[21] Appl. No.: 736,149

[22] Filed: Oct. 27, 1976

[51] Int. Cl.[2] ..... E21C 35/20

[52] U.S. Cl. ..... 299/34; 299/45

[58] Field of Search ..... 299/45, 34, 32

[56] References Cited

FOREIGN PATENT DOCUMENTS

| | | | |
|---|---|---|---|
| 1,245,889 | 8/1967 | Germany | 299/34 |
| 964,134 | 5/1957 | Germany | 299/32 |
| 1,207,313 | 12/1965 | Germany | 299/34 |

*Primary Examiner*—Ernest R. Purser

*Attorney, Agent, or Firm*—Blair & Brown

[57] ABSTRACT

A plow cutter assembly to be used in the strip mining of coal, the assembly comprising a container having a plurality of steel spikes mounted at an angle on its lower face. A hoist pulls the assembly along the face of a coal vein and the spikes shave off layers of coal.

9 Claims, 12 Drawing Figures

FIG. 4.
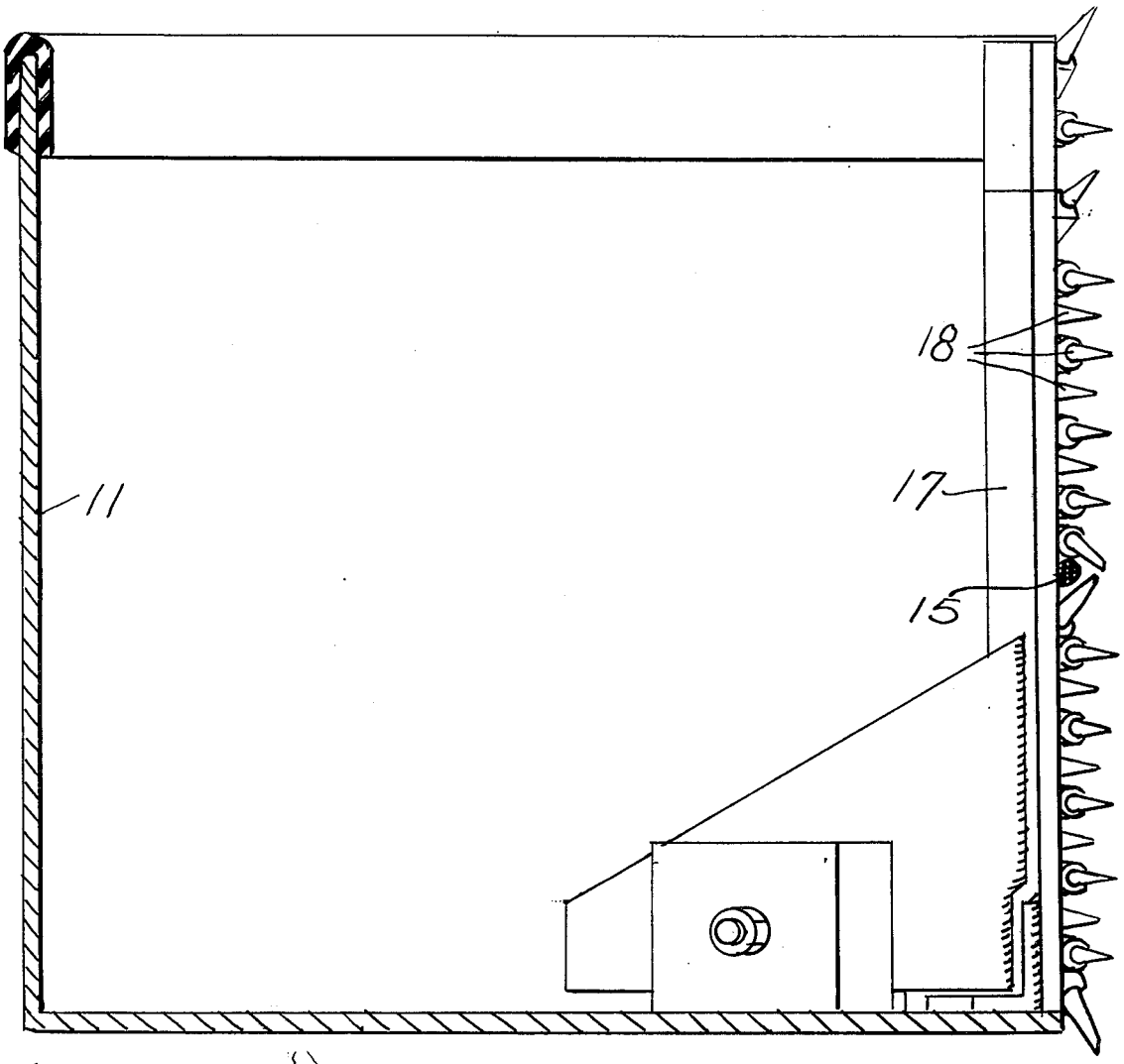
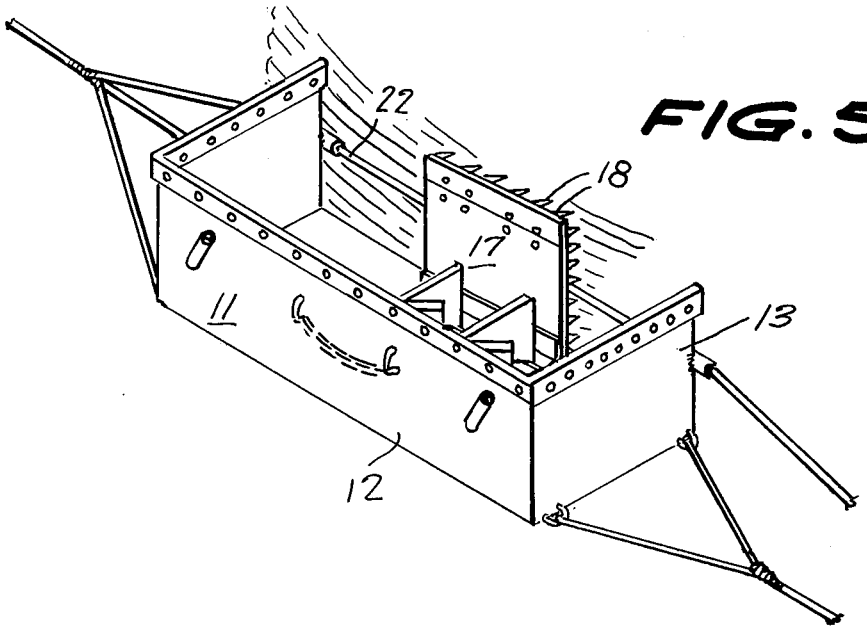
FIG. 5.

FIG. 6.
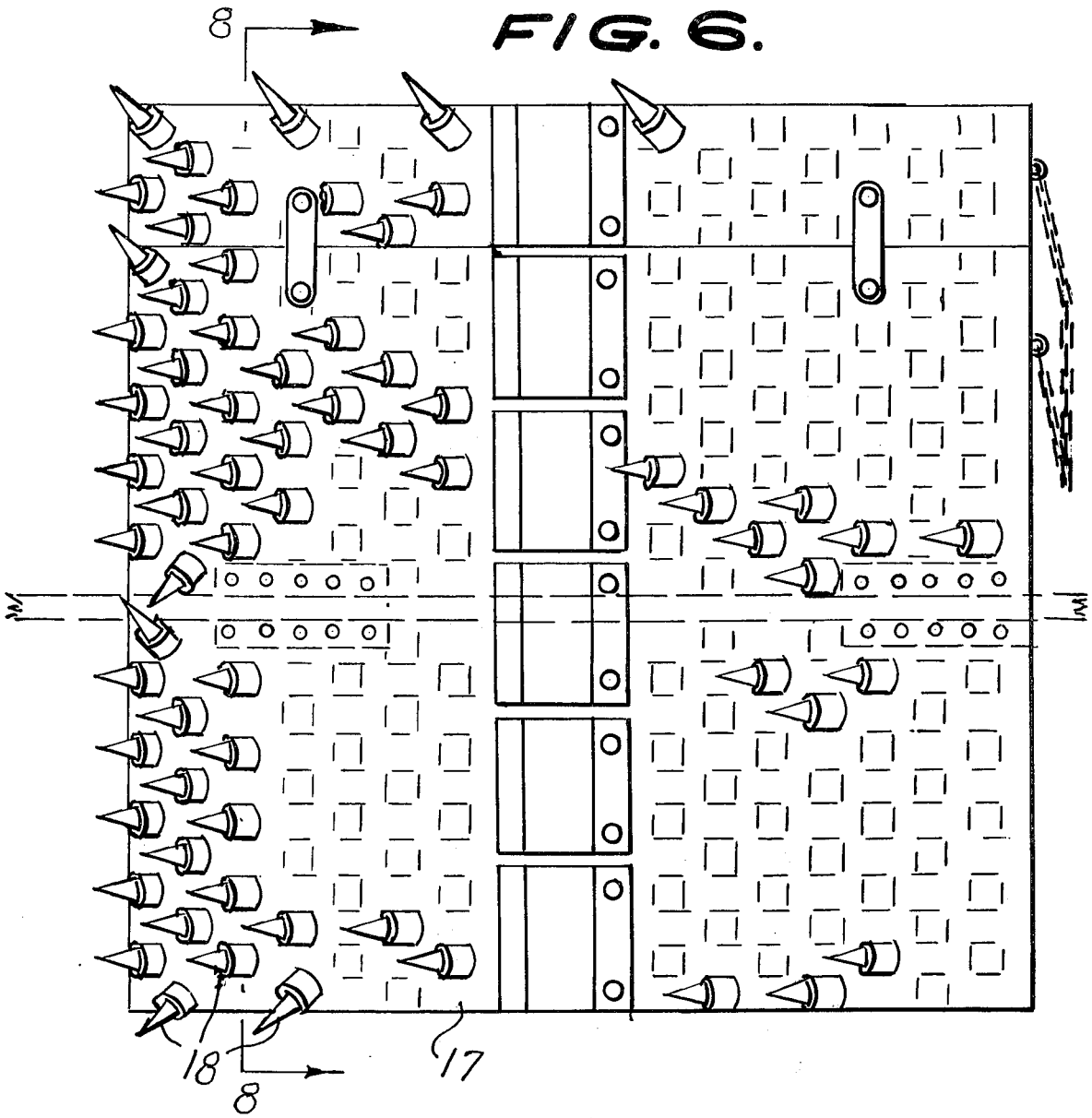
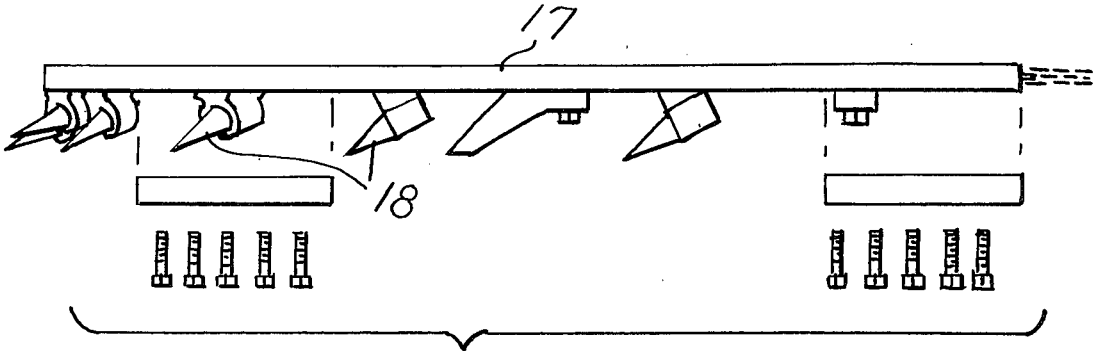
FIG. 7.

FIG. 8.
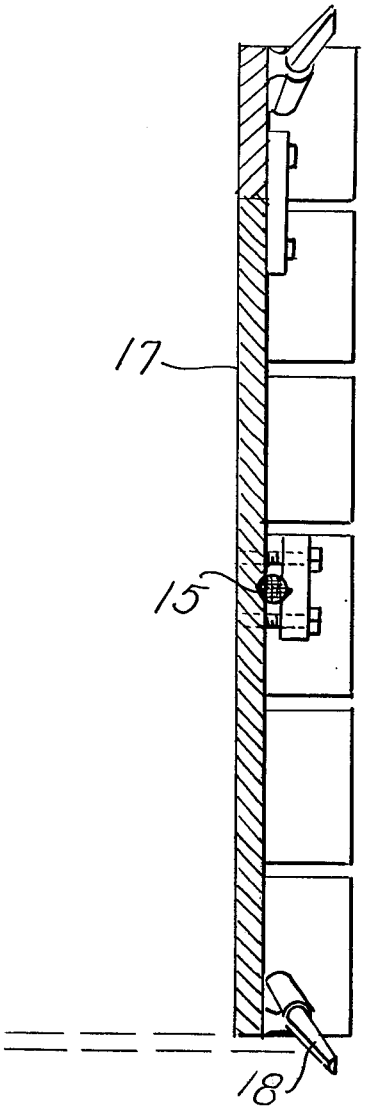
FIG. 9.
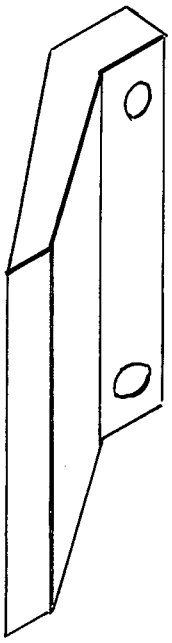
FIG. 10.
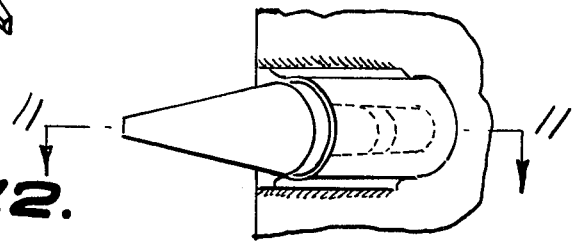
FIG. 12.
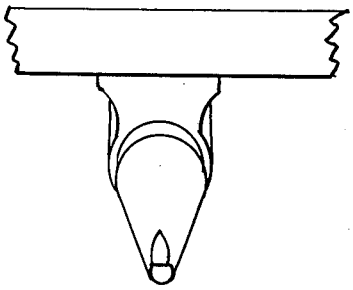
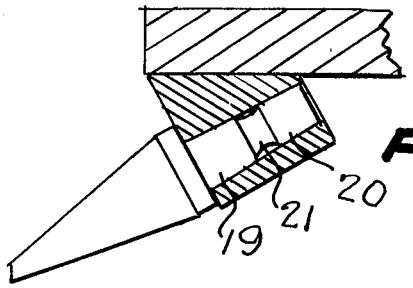
FIG. 11.

PLOW CUTTER ASSEMBLY

BACKGROUND OF THE INVENTION

Field of the Invention

Over the past years wherein coal has been needed by civilization, the majority of this coal has been obtained by having personnel below ground to dig out the coal, a procedure which is harmful and dangerous to workers. Present day strip mining and auger mining eliminates most of the old dangers since personnel are not below ground, but these systems do not recover all of the coal available, and the cost per ton is not low.

The present invention relates to a plow cutter assembly for obtaining coal.

SUMMARY OF THE INVENTION

The present invention of a plow cutter assembly for use in obtaining coal includes a container have a plurality of steel spikes set at an angle in the side of the container, the spikes being pulled along the surface of a vein of coal, in the side of a mountain, so that they shave off the coal which is then collected in the container. A tow rope, attached to the container, passes through the mountain, and is wound on a hoist to pull the assembly through or around the side of the mountain to dig out the coal.

The primary object of the invention is to provide an assembly that assists in strip mining of coal.

Other objects and advantages will become apparent in the following specification when considered in light of the attached drawings.

BRIEF DESCRIPTION OF THE DRAWINGS

FIG. 4 shows a top plan view of the invention;

FIG. 5 is an oblique view of one form of the invention with the spikes located in one side of the carriage;

FIG. 6 is a view taken along the lines 6—6 of FIG. 3 looking in the direction of the arrows;

FIG. 7 is an elevation view showing one means of mounting the spikes;

FIG. 8 is a view taken along the lines 8—8 of FIG. 6, looking in the direction of the arrows;

FIG. 9 is a oblique view of one of the scoops;

FIG. 10 is a view of one form of steel spike;

FIG. 11 is a view taken along the line 11—11 of FIG. 10 looking in the direction of the arrows; and FIG. 12 is a front view of one of the round steel spikes.

DESCRIPTION OF THE PREFERRED EMBODIMENT

Figure 2:
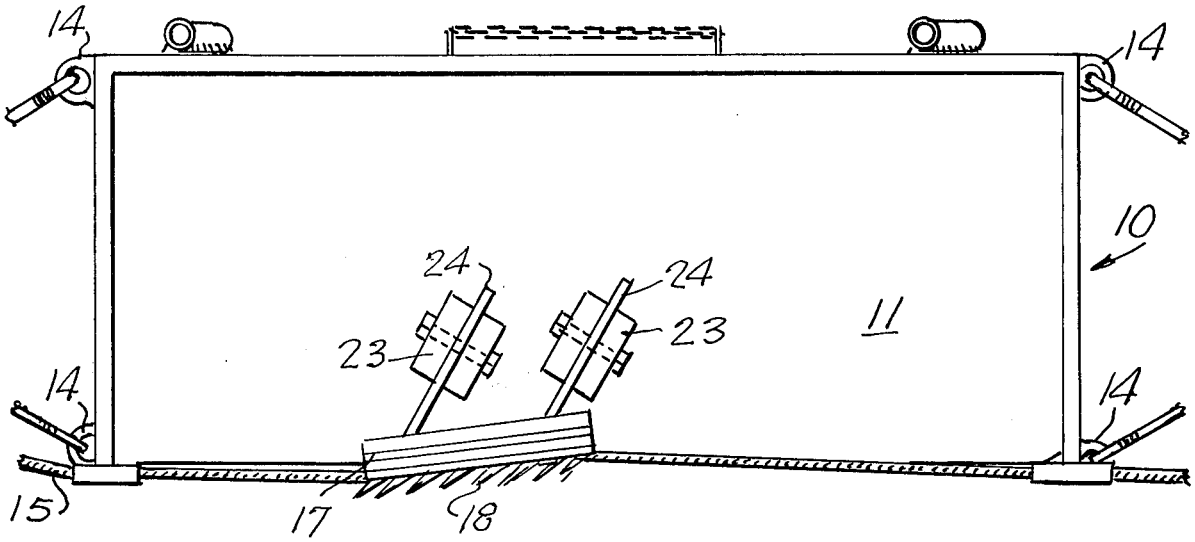
FIG. 2 is an elevation view of the invention.
Figure 3:
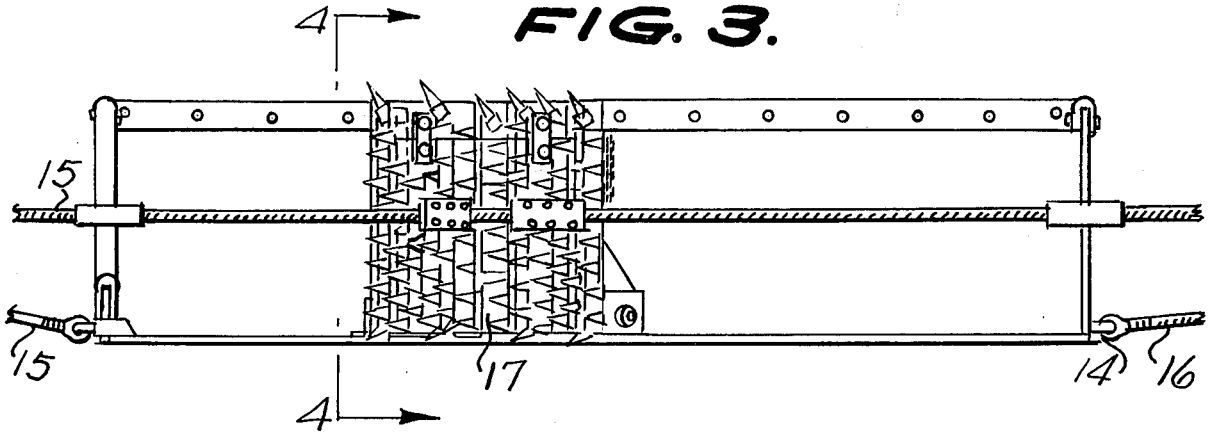
FIG. 3 is a bottom view of the invention showing how the plurality of spikes may be located.

Referring now to the drawings in detail, wherein like reference characters indicate like parts throughout the several figures, the reference numeral 10 indicates generally a plow cutter assembly incorporating a rectangular, box-like carriage indicated generally at 11.

The box-like carriage 11 is preferably of a generally rectangular configuration with a long side 12 and two smaller ends 13, smaller ends 13 having a plurality of eye bolts 14 at their corners for attachment of tow ropes 15 and 16. Tow rope 15 is attached to the front end of the carriage, while tow rope 16 is fastened to the rear or after end, as will be seen more hereinafter.

Forming a part of one of the long sides 12 of carriage 11 there is an area 17 which is composed of a plurality of angled spikes 18. From several of the figures it can be observed that spikes 18 are generally angled in the same, or a forward, direction so that a pull on front tow rope 15 serves to imbed, or dig into a coal deposit, all of the spikes 18. All of spikes 18 are not in an orderly, completely regimented line, but they all do point in a forward direction so that when pulled against the vein of coal they act to shave off coal and deposit it into the hollow recess of carriage 11, for further use.

The digging spikes 18 may take any of several configurations, as shown by various figures of the drawings, but of course they are all made from case hardened steel, and sharply pointed. In FIG. 8 they are generally wedge shaped, pointed, and may have some flat sides. In FIGS. 10, 11 and 12 the spikes 18 are cylindrical, and taper to a point. Their fixed inner ends 19 are smaller in diameter and are held in a mounting 20 by means of a channel 21 cut into the narrowed end.

Referred briefly back to FIG. 5, in that modification, the area 17 which holds spikes 18 forms only a portion of one of the long sides 12 of carriage 11, the area 17 being firmly attached to a rigid bar 22 along the side.

Also looking back at FIG. 2 there is shown a means for keeping spikes 18 and area 17 at a good cutting angle. This is accomplished by two angled weights 23 which are mounted atop area 17 by being screwed to short posts 24, the posts, as can be observed, are slightly off the vertical so as to add pressure to the spikes.

In the use and operation of the device it is most effective in stripping coal from a vein of coal that is approachable from the surface of the ground, and this is a method of extracting coal which lies near the surface where there is not too much over-burden, with the seam of coal exposed at the starting point. Additionally, the system may be used underground.

Figure 1:
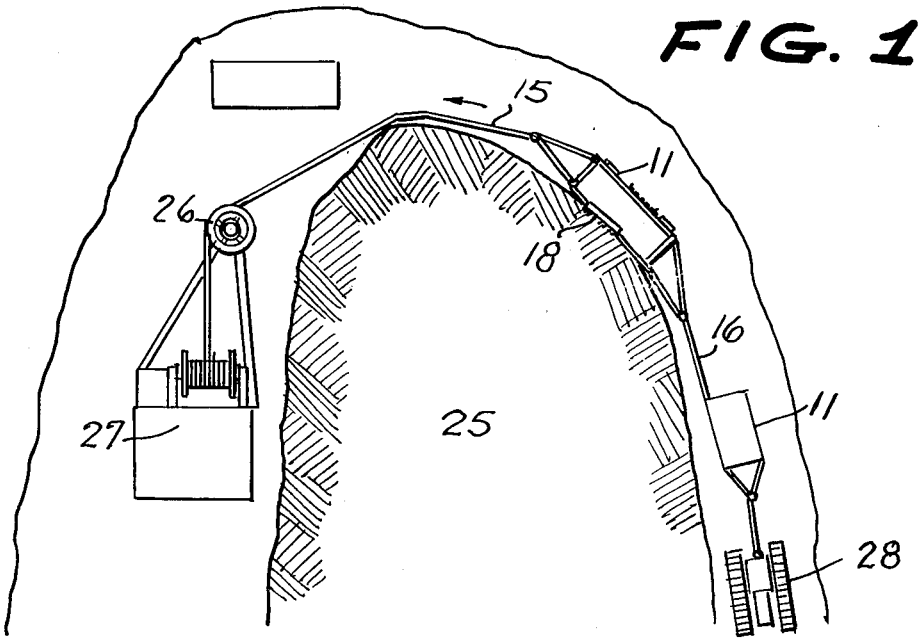
FIG. 1 shows an elevation view of the invention being applied to a vein of coal.

The plow cutter assembly is mounted on a cable, wrapped around a hoist on one side and going around a sheave wheel on the other side of the hill. This all lies horizontally along the coal seam (FIG. 1 is not over a hill top) allowing the plow cutter to move back and forth horizontally, cutting out the coal. The only other cable involved is that which is used to pull the wooden crib supports in behind the cutting apparatus, to support the roof where the coal has been removed. This also is pulled in horizontally.

The system requires a curved face because it aids in cutting or plowing the coal. Steel ropes or cables hold the plow cutter assembly against the coal face. Depending on which one is used, the trough with the integral rope and segment conveyor or the sled carrier, both would also be held into the coal face by ropes or cables. The rope travels across the long wall face and around an anchored sleeve at the other end of the long wall face. The sheave on one end of the long wall coal face and the hoist on the other end of the long wall face are moved, as needed, to keep the coal face in the desired curved configuration. This assures efficiency in cutting the coal.

If the cutter is being used in a tunnel, then roof supports or cribs the height of the tunnel, will be pulled along in a curved line behind the long wall if they are needed to support the mined out areas.

Having thus described the preferred embodiment of the invention it should be understood that numerous structural modifications and adaptations may be resorted to without departing from the spirit of the invention.

I claim:

1. An apparatus to be pulled in a direction of travel for scraping and conveying coal from a mining site to a point remote therefrom comprising, at least one hollow rectanguloid container having two open faces which are substantially parallel to the direction of travel of the container, and two closed faces also parallel to the direction of travel and disposed orthogonally to each other, and two end walls perpendicular to the direction of travel and connected to said closed faces provided with means for pulling said container along the face of a coal deposit, and means disposed on one of said closed faces within said container for attaching scraping means thereto so that said scraping means extends out from at least one of said open faces to provide a cutting surface.

2. The apparatus of claim 1 in which said means for pulling said container include hooks on said end walls attached by cables to be pulled along.

3. The apparatus of claim 2 in which said means disposed on one of said closed faces and said scraping means includes a support plate for carrying a plurality of cutting and chiselling elements which are oriented to coact with a coal seam, weights disposed on the back face of said support plate to provide additional cutting support and pressure, and support posts disposed on said closed face within said container connected to said weights to carry said support plate.

4. The apparatus of claim 3 including further support for said support plate comprising a cable extending between said end walls overlying and fastened to said support plate.

5. The device of claim 3 wherein said cutting and chiselling elements are steel spikes 6. The device of claim 5 wherein the spikes are slanted forward to dig into the coal.

7. The device of claim 6 wherein there are rows of spikes set at various forward angles.

8. The device of claim 7 including a slot in the side of the container to admit shaved coal into the container.

9. The device of claim 8 wherein the spikes are detachable.

* * * * *